US010603548B2

(12) United States Patent
Chiang

(10) Patent No.: US 10,603,548 B2
(45) Date of Patent: Mar. 31, 2020

(54) SWIMMING GOGGLES

(71) Applicant: Global Esprit Inc., New Taipei (TW)

(72) Inventor: Herman Chiang, New Taipei (TW)

( * ) Notice: Subject to any disclaimer, the term of this patent is extended or adjusted under 35 U.S.C. 154(b) by 192 days.

(21) Appl. No.: 15/721,966

(22) Filed: Oct. 2, 2017

(65) Prior Publication Data

US 2019/0054349 A1 Feb. 21, 2019

(30) Foreign Application Priority Data

Aug. 18, 2017 (TW) ..... 106212308 U

(51) Int. Cl.
*A61F 9/02* (2006.01)
*A63B 33/00* (2006.01)

(52) U.S. Cl.
CPC ..... *A63B 33/002* (2013.01); *A63B 2033/004* (2013.01)

(58) Field of Classification Search
CPC .. A63B 2033/004; A63B 33/002; A63B 35/00
USPC ..... 2/428
See application file for complete search history.

(56) References Cited

U.S. PATENT DOCUMENTS

2013/0283509 A1* 10/2013 Chiang ..... A63B 33/002 2/442

* cited by examiner

*Primary Examiner* — Timothy K Trieu

(57) ABSTRACT

Swimming goggles of the present invention comprise a hard combining frame, a left soft frame, and a right soft frame. The hard combining frame is composed of a first embedding frame and a second embedding frame, each having an embedding hole. The left and right soft frames are respectively assembled with the embedding holes. Each of the left and right soft frames is composed of a frame portion and a face contact portion. The frame portion assembled with each of the left and right soft frames receives a lens, characterized in that: the face contact portion is disposed with a flange rib with respect to an edge of the lens, to provide the face contact portion with a buffer against an impact caused when being compressed and deformed in wearing, and to provide a desired engagement without pressure stress and water leakage to ensure a wearing comfort.

10 Claims, 5 Drawing Sheets

SWIMMING GOGGLES

BACKGROUND OF THE INVENTION

1. Field of the Invention

The present invention relates generally to swimming goggles and in particular to a swimming goggle structure which provides a comfortable engagement with the wearer's skin without water leakage, and is suitable for wearers who have different face contours and/or nose contours.

2. Related Art

Swimming goggles are chiefly designed to avoid the contact of the wearer's eyes with water for eye protection in swimming Thus, the design of protection pads is very important. Conventionally, each protection pad of sucked type having a J shape in appearance is engaged to the wearer's face around the eye socket by means of an adsorptive force produced when the J-shaped protection pad is compressed and deformed in wearing. However, the J-shaped protection pad is found not perfectly matched with the contour of the wearer's eye socket, in that the J-shaped protection pad is formed of a unitary arc surface, i.e. same heights in its upper half part and its lower half part, which is not fit onto the wearer's eye socket having an unsymmetrical contour such as a contour formed by a raised top and a concave bottom. In this manner, a stronger pull force must be applied on the head strap in wearing for the balance of the deformation or adsorptive force around of the protection pad to avoid water leakage. However, the stronger pull force applied may bring uncomfortable contact and cause the formation of panda eyes in the wearer's face, and it may have a chance to cause a poor water leakage proof attachment to the contour of the wearer's eye socket along with the deformation of the protection pad. The perfect match of the J-shaped protection pad with the contour of the wearer's eye socket can be achieved, only if the J-shaped protection pad is well designed to make its upper half part and its lower half part as different heights to ensure the water-tight engagement of the protection pad with the contour of the wearer's eye socket.

Further, the protection pad of sucked type, as above, is formed of the unitary arc surface having same heights in its upper half part and it lower half part. When worn by the wearer whose face is smaller, the protection pad is hard to perfectly match the contour of the eye socket, and thus causes water leakage. When worn by the wearer whose face is larger, the protection pad may curl up from its edges, and thus causes water leakage. Briefly, the conventional protection pad of sucked type designed in the form of the unitary arc surface having same heights in its upper half par and its lower half part fails to meet the needs of all wearers who have different face sizes, and may create a poor water leakage proof attachment to the contour of the wearer's eye socket. In addition, a connection element used for interconnecting left and right lens frames is made of hard material in lack of flexibility, and fails to meet the needs of the wearers who have different nose bridge contours, especially for wearers who have taller nose bridges. Besides, the lack of flexibility of the protection pad may cause the left and right lens frames a poor water leakage proof attachment to the contour of the wearer's eye socket

SUMMARY OF THE INVENTION

An object of the present invention is to provide swimming goggles with face contact portions of sucked type, which provide a buffer against an impact caused when being compressed and deformed in wearing, and provide a desired engagement with the wearer's skin without any pressure stress or water leakage, so as to ensure a wearing comfort.

Another object of the present invention is to provide swimming goggles suitable for the wearers with different face contours, including a flexible edge design for compliance with different wearers' face contours, a flexible connection element design for compliance with different wearers' nose bridge contours, so as to be suitable for the wearers who have different face contours and nose bridge contours, without causing any pressure stress or water leakage, so as to ensure a wearing comfort.

To attain this, swimming goggles in accordance with the present invention, comprise a hard combining frame, a left soft frame, a right soft frame, and two hard head strap buckles. The hard combining frame is composed of a first embedding frame, a second embedding frame, and a connection element interconnecting the first embedding frame and the second embedding frame. Each of the first embedding frame and the second embedding frame has an embedding hole. The left soft frame and the right soft frame are respectively assembled with the embedding holes of the first embedding frame and the second embedding frame. Each of the left soft frame and the right soft frame is composed of a frame portion and a face contact portion. The frame portion is received in the embedding hole and is punched inward to form a receiving groove to receive a lens. The swimming goggles in accordance with the present invention are characterized in that: the face contact portion is disposed with a flange rib with respect to an edge of the lens, so as to provide a buffer against an impact caused when being compressed and deformed.

Accordingly, each of the first embedding frame and the second embedding frame has an extension section. The extension section comprises a first stretching part. The first stretching part is formed with a cut angle at an edge of the extension section, so as to provide the extension section with stretching flexibility in wearing.

Accordingly, the extension section further comprises a second stretching part. The second stretching part includes at least a recess and rib strips. The recess is recessed from a surface of the extension section toward the first stretching part. The rib strips are respectively arranged above and below the recess to provide the extension section with stretching flexibility in wearing.

Accordingly, the connection element is made of thermoplastic rubber by injection molding, capable of bonding different plastic materials, so as to be integrally formed with the hard combining frame and to provide flexibility by virtue of material properties, so that the connection element is capable of providing a compliance with the wearer's nose bridge contour.

Accordingly, a side contour of the face contact portion, with respect to the outer eye corner in use, is extended outward and abruptly bent inward to form a convex portion as being in a shape of a cap, so as to provide the wearer's outer eye corner with a covering and sticky effect. Further, a first height of the an upper half part of the face contact portion is smaller than a second height of a lower half part of the face contact portion, so that after the swimming goggles are worn, the face contact portion is the compliance with the wearer's eye socket contour without creating any pressure stress.

DESCRIPTION OF THE INVENTION

Figure 1:
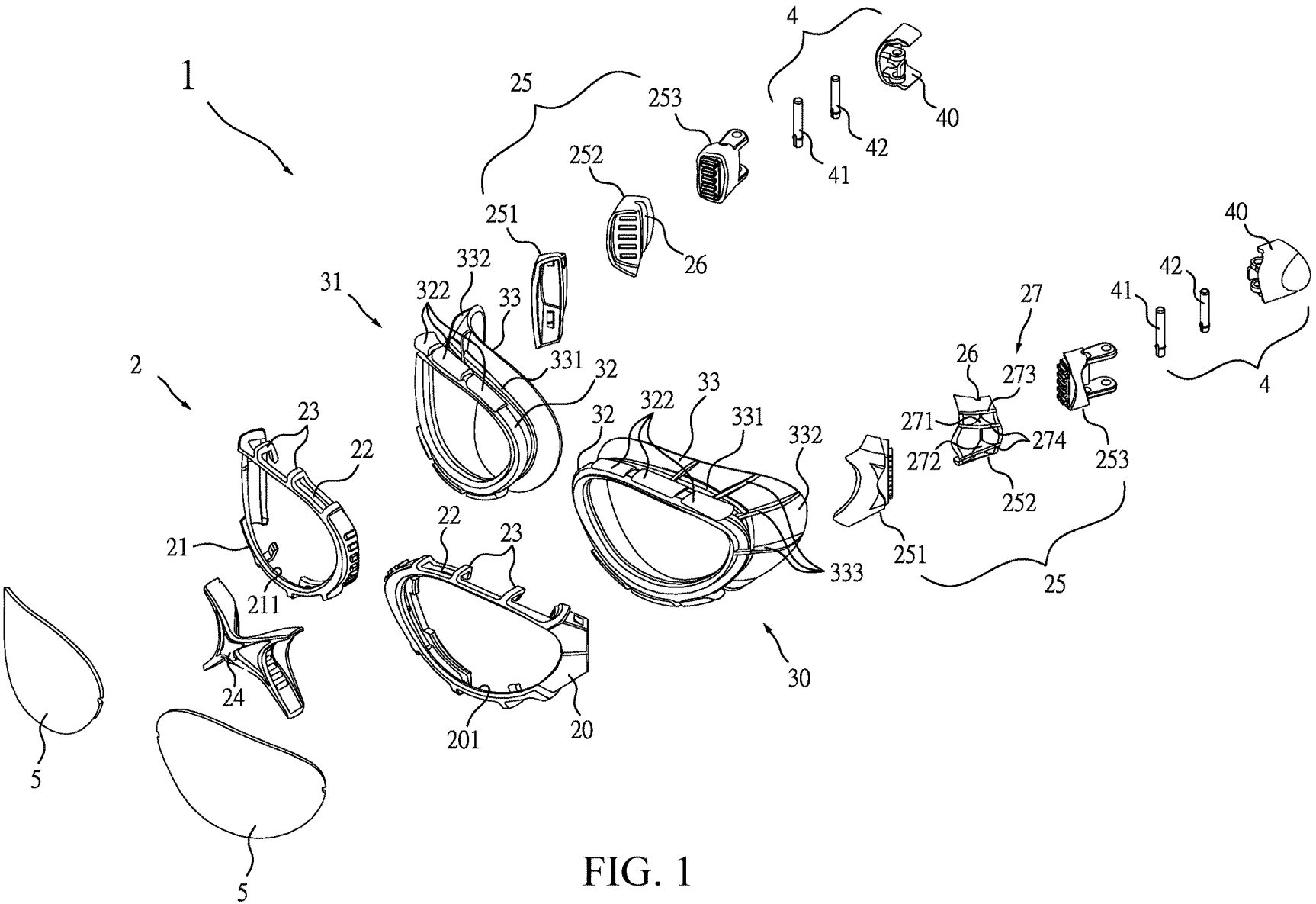
FIG. 1 is an exploded perspective view of swimming goggles in accordance with the present invention.
Figure 2:
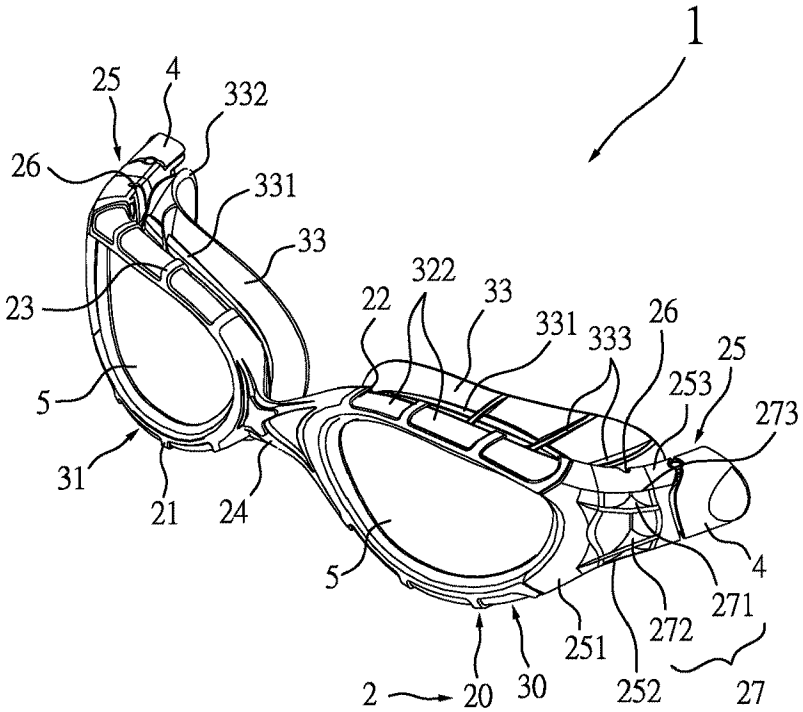
FIG. 2 is an assembly perspective view of FIG. 1.

Please refer to FIG. 1 and FIG. 2, swimming goggles 1 in accordance with the present invention include a hard combining frame 2, a left soft frame 30, a right soft frame 31, and two hard head strap buckles 4. The hard combining frame 2 is made of polypropylene (PP) and composed of a first embedding frame 20, a second embedding frame 21, and a connection element 24 that interconnects the first embedding frame 20 and the second embedding frame 21. The first embedding frame 20 has an embedding hole 201, and the second embedding frame 21 has an embedding hole 211. The left soft frame 30 and the right soft frame 31 are respectively received in the embedding hole 201 and the embedding hole 211. For ease of receiving of the left soft frame 30 and the right soft frame 31 by the embedding hole 201 and the embedding hole 211, each of the first embedding frame 20 and the second embedding frame 21 has at least an arc lane 22 and at least a pair of arms 23 mounted around the embedding hole 201(211) in order to combine each of the left soft frame 30 and the right soft frame 31. The connection element 24 is made of thermoplastic rubber (TPR) by injection molding, capable of bonding different plastic materials, so that the connection element 24 is integrally formed with the first embedding frame 20 and the second embedding frame 21. The thermoplastic rubber made as soft material provides flexible and comfortable engagement with the wearer's face skin without water leakage by means of the connection element 24 complying with the wearer's nose bridge contour.

Further, each of the first embedding frame 20 and the second embedding frame 21 has an extension section 25. The extension section 25 is made of polypropylene (PP) and composed of a front segment 251, a middle segment 252 and a rear segment 253. The front segment 251 is connected to each of the first embedding frame 20 and the second embedding frame 21. The middle segment 252 comprises a first stretching part 26 and a second stretching part 27. The first stretching part 26 is formed with a cut angle at an edge of the middle segment 252 to provide the extension section 25 with stretching flexibility in wearing. The second stretching part 27 includes a first recess 271, a second recess 272, and rib strips 273,274. The first recess 271 and the second recess 272 are stacked on each other and recessed from a surface of the middle segment 252 toward the first stretching part 26. The rib strips 273,274 are respectively arranged above the first recess 271 and below the second recess 272 to provide the extension section 25 with stretching flexibility in wearing. The rear segment 253 is connected to each of the two hard head strap buckles 4. Therefore, the provision of the extension section 25 with stretching flexibility benefits the swimming goggles 1 complying with the wearer's face contour in wearing.

Figure 3:
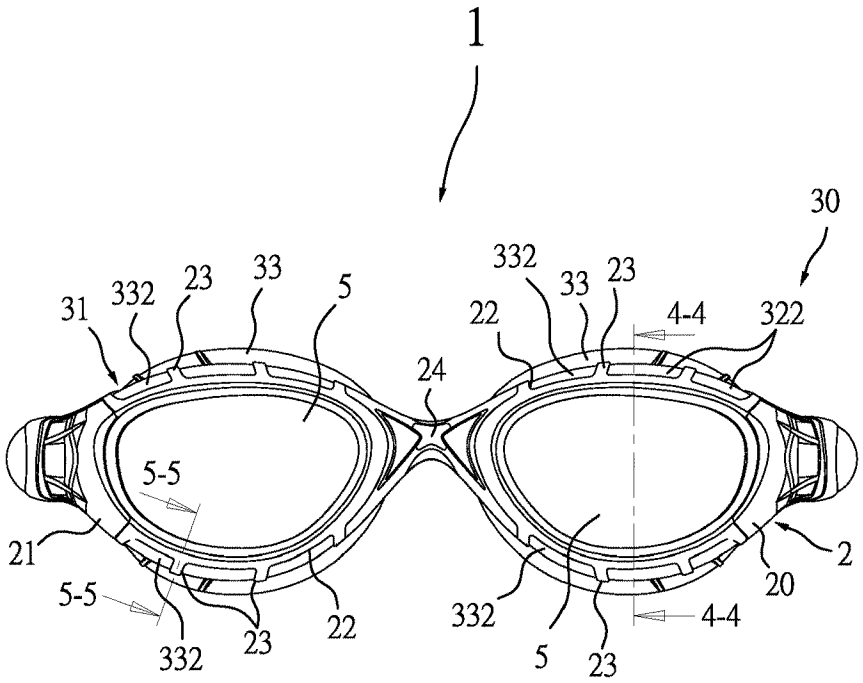
FIG. 3 is a front view of FIG. 2.
Figure 5:
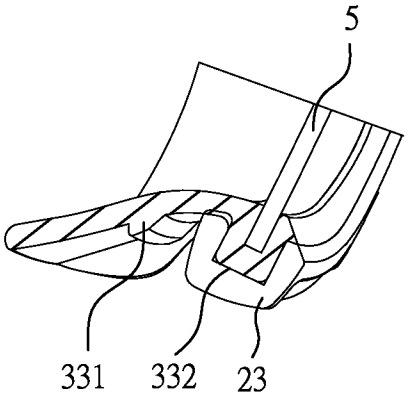
FIG. 4 and FIG. 5 are cross-sectional views taken along lines 4-4 and 5-5 of FIG. 3.
Figure 4:
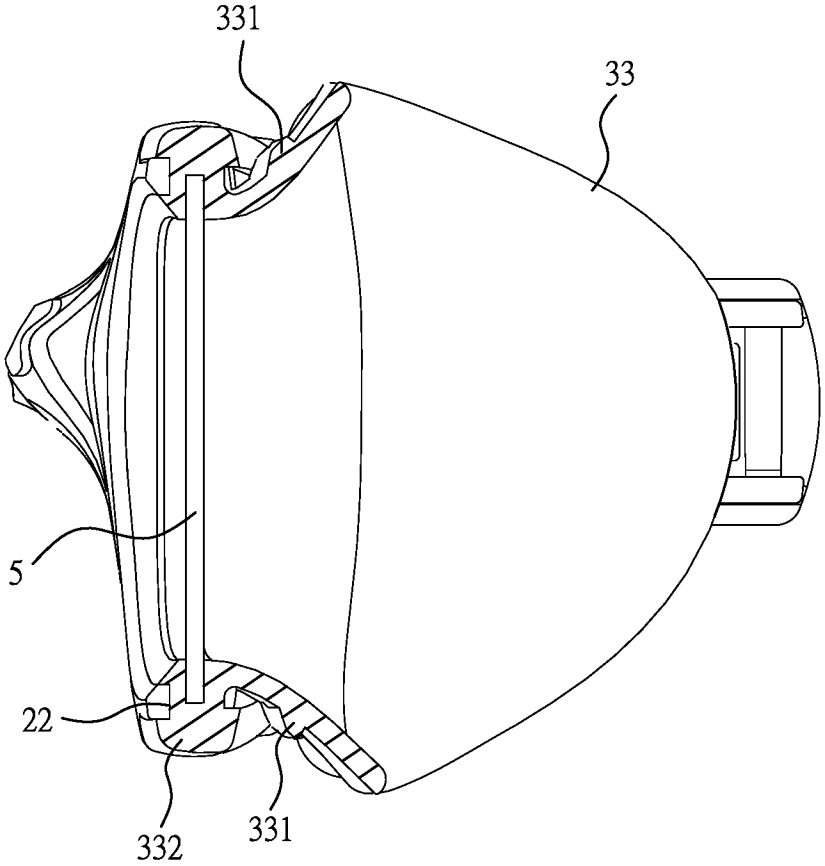
Figure 6:
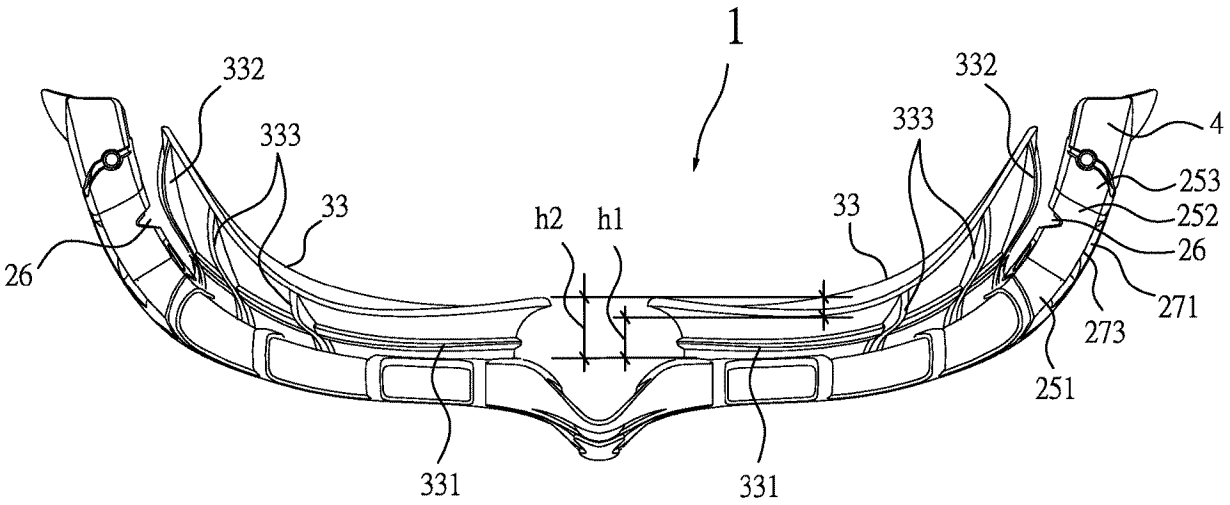
FIG. 6 and FIG. 7 are top and bottom views of FIG. 2.
Figure 7:
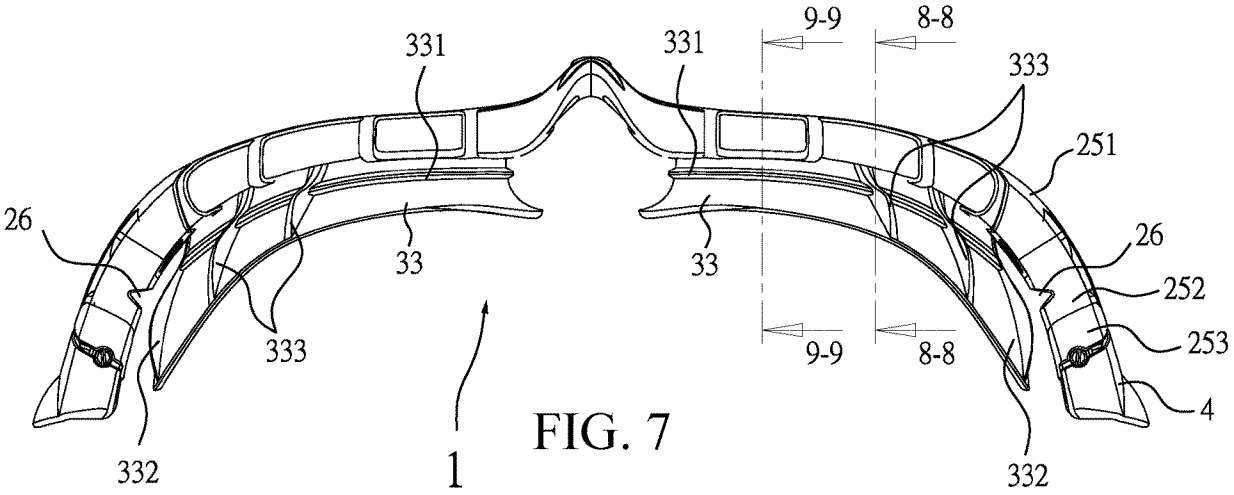
Figure 9:
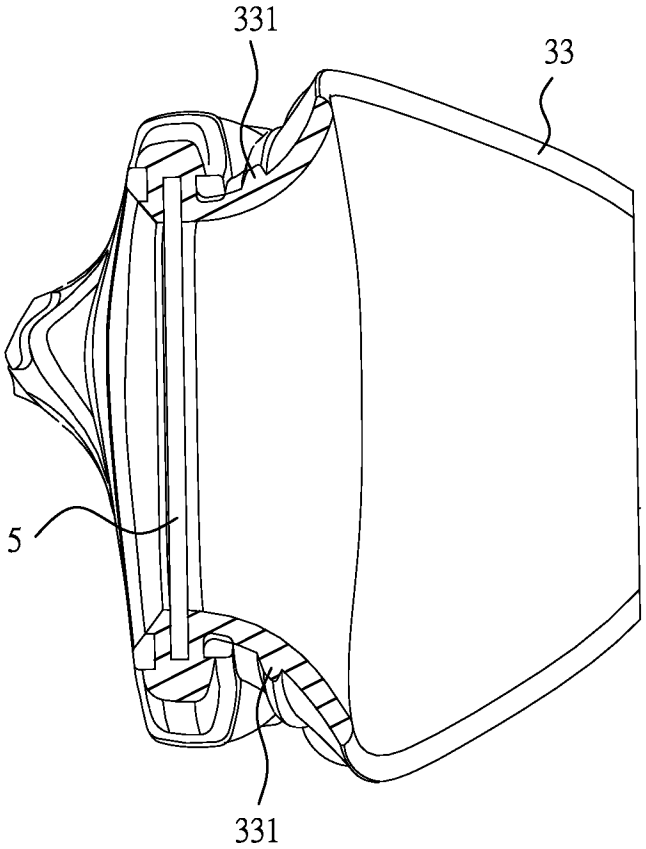
FIG. 8 and FIG. 9 are cross-sectional views taken along lines 8-8 and 9-9 of FIG. 7.
Figure 8:
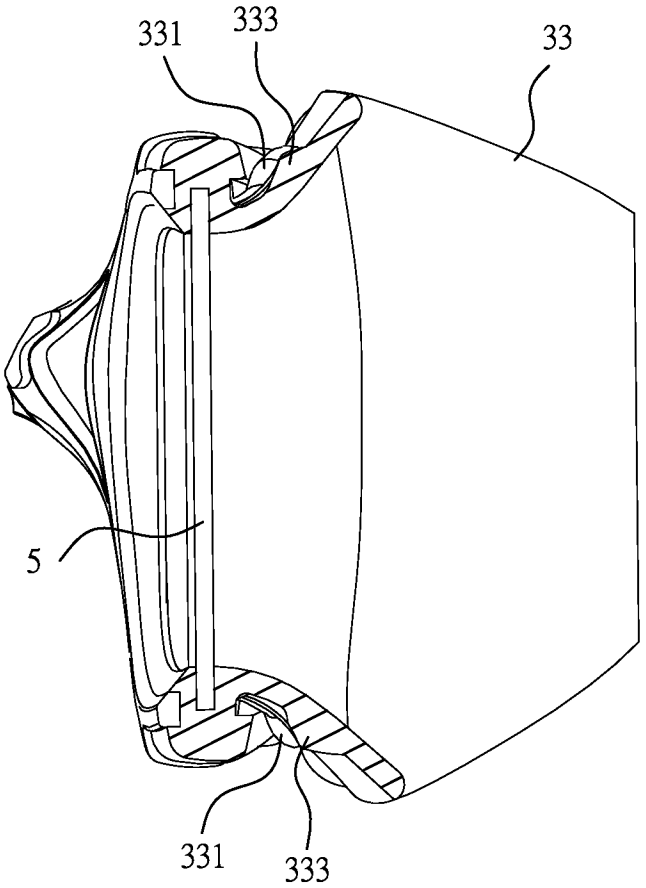

The left soft frame 30 and the right soft frame 31 are made of silicon rubber. Each of the left soft frame 30 and the right soft frame 31 is composed of a frame portion 32 and a face contact portion 33. The frame portion 32 has an inner wall and an outer wall. The inner wall of the frame portion 32 is punched inward to form a receiving groove 321 to receive a lens 5. The outer wall of the frame portion 32 is protruded outward to form a plurality of blocks 322 at intervals. The plurality of blocks 322 are embedded in the at least an arc lane 22 and the at least a pair of arms 23. With reference to FIG. 1 in view of FIG. 3 to FIG. 5, each of the left soft frame 30 and the right soft frame 31 is assembled with each of the embedding holes 201,211 of the first embedding frame 20 and the second embedding frame 21 by means of multi-stage clamping fixation. In practice, each of the first embedding frame 20 and the second embedding frame 21 is mounted with the at least an arc lane 22 at a side adjacent to the connection element 24 (FIG. 4), and with the at least a pair of arms 23 arranged side by side with the arc lane 22 (FIG. 5). The frame portion 32 of each of the left soft frame 30 and the right soft frame 31 is then fixed around the embedding hole 201(211) of each of the first embedding frame 20 and the second embedding frame 21 by means of the at least an arc lane 22 and the at least a pair of arms 23 corporately clamping the plurality of blocks 322. Further in view of FIG. 6 to FIG. 9, the face contact portion 33 of each of the left soft frame 30 and the right soft frame 31 is disposed with a flange rib 331 (in a shape of a circle as shown) with respect to an edge of the lens 5 (FIG. 9), in order to provide the face contact portion 33 with a buffer against an impact caused when the face contact portion 33 is compressed and deformed in wearing. In addition, a side contour of the face contact portion 33, with respect to the outer eye corner in use, is extended outward and abruptly bent inward to form a convex portion 332 as being in a shape of a cap (FIG. 6 and FIG. 7), so as to provide the wearer's outer eye corner with a covering and sticky effect. Further, the convex portion 332 is longitudinally disposed with a plurality of strengthening ribs 333 (FIG. 8) to enhance a structural strength of the convex portion 332 and to avoid the face contact portion 33 to be easily collapsed. Further, an upper half part of the face contact portion 33, with respect to the wearer's eyebrow in use, has a first height h1 (FIG. 6), and a lower half part of the face contact portion 33, with respect to the wearer's cheek bone in use, has a second height h2, wherein the first height h1 is smaller than the second height h2, so that after the swimming goggles 1 are worn, the face contact portion 33 is the compliance with the wearer's eye socket contour without creating any pressure stress.

The two hard head strap buckles 4 are made of nylon. Each of the two hard head strap buckles 4 is connected to the rear segment 253 of the extension section 25. Each of the two hard head strap buckles 4 has a body 40 and two guidance pillars 41,42. The two guidance pillars 41,42 are vertically arranged in the body 40 to form a guidance hole. The guidance hole provides a head strap (not shown) to pass therethrough.

In sum, with reference to FIG. 1 in view of FIG. 6 to FIG. 9, the face contact portion 33 of each of the left soft frame 30 and the right soft frame 31 is disposed with the flange rib 331 with respect to the edge of the lens 5 (FIG. 9), in order to provide the face contact portion 33 with a buffer against an impact caused when the face contact portion 33 is compressed and deformed in wearing, so as to provide a desired engagement with the wearer's skin without causing pressure stress and water leakage to ensure a wearing comfort. Further, the convex portion 332 is longitudinally disposed with a plurality of strengthening ribs 333 (FIG. 8) to enhance a structural strength of the convex portion 332 and to avoid the face contact portion 33 to be easily collapsed. In other word, the face contact portion 33 is not easily deformed while the head strap is being pulled backward, so as to hermetically attach to wearer's eye socket.

Further, the first height h1 of the upper half part of the face contact portion 33 is smaller than the second height h2 of the lower half part of the face contact portion 33, so that after the swimming goggles 1 are worn, the face contact portion 33 is the compliance with the wearer's eye socket contour without creating any pressure stress.

It is understood that the invention may be embodied in other forms within the scope of the claims. Thus the present examples and embodiments are to be considered in all respects as illustrative, and not restrictive, of the invention defined by the claims.

What is claimed is:

1. A swimming goggles, comprising:

a hard combining frame, composed of a first embedding frame, a second embedding frame, and a connection element interconnecting the first embedding frame and the second embedding frame, each of the first embedding frame and the second embedding frame having an embedding hole;

a left soft frame and a right soft frame, respectively assembled with the embedding holes of the first embedding frame and the second embedding frame, each of the left soft frame and the right soft frame being composed of a frame portion and a face contact portion, the frame portion having an inner wall, the inner wall of the frame portion being punched inward to form a receiving groove to receive a lens, the face contact portion being disposed with a flange rib with respect to an edge of the lens; and two hard head strap buckles, respectively connected to the first embedding frame and the second embedding frame, each of the two hard head strap buckles forming a guidance hole to provide a head strap to pass therethrough;

wherein each of the first embedding frame and the second embedding frame has an extension section, the extension section comprising a first stretching part, the first stretching part being formed with a cut angle at an edge of the extension section, so as to provide the extension section with stretching flexibility in wearing;

wherein the extension section further comprises a second stretching part, the second stretching part including at least a recess and rib strips, the recess being recessed from a surface of the extension section toward the first stretching part, the rib strips being respectively arranged above and below the recess to provide the extension section with stretching flexibility in wearing.

2. The swimming goggles of claim 1, wherein the flange rib of the face contact portion disposed with respect to the edge of the lens has a shape of a circle.

3. The swimming goggles of claim 1, wherein the hard combining frame, the extension section, the connection element, and the two hard head strap buckles are integrally formed together, the hard combining frame and the extension section being made of polypropylene, the connection element being made of thermoplastic rubber by injection molding capable of bonding different plastic materials, the two hard head strap buckles being made of nylon.

4. The swimming goggles of claim 3, wherein the extension section is composed of a front segment, a middle segment and a rear segment, the front segment being connected to each of the first embedding frame and the second embedding frame, the middle segment comprising the first stretching part and the second stretching part, the rear segment being connected to each of the two hard head strap buckles.

5. A swimming goggles, comprising:

a hard combining frame, composed of a first embedding frame, a second embedding frame, and a connection element interconnecting the first embedding frame and the second embedding frame, each of the first embedding frame and the second embedding frame having an embedding hole;

a left soft frame and a right soft frame, respectively assembled with the embedding holes of the first embedding frame and the second embedding frame, each of the left soft frame and the right soft frame being composed of a frame portion and a face contact portion, the frame portion having an inner wall, the inner wall of the frame portion being punched inward to form a receiving groove to receive a lens, the face contact portion being disposed with a flange rib with respect to an edge of the lens; and two hard head strap buckles, respectively connected to the first embedding frame and the second embedding frame, each of the two hard head strap buckles forming a guidance hole to provide a head strap to pass therethrough;

wherein a side contour of the face contact portion, with respect to a wearer's outer eye corner, is extended outward and abruptly bent inward to form a convex portion as being in a shape of a cap, so as to provide the wearer's outer eye corner with a covering and sticky effect;

wherein the convex portion is longitudinally disposed with a plurality of strengthening ribs to enhance a structural strength of the convex portion and to avoid the face contact portion to be easily collapsed.

6. The swimming goggles of claim 5, wherein the flange rib of the face contact portion disposed with respect to the edge of the lens has a shape of a circle.

7. The swimming goggles of claim 5, wherein an upper half part of the face contact portion, with respect to a wearer's eyebrow, has a first height, and a lower half part of the face contact portion, with respect to the wearer's cheek bone, has a second height, wherein the first height is smaller than the second height, so that after the swimming goggles are worn, the face contact portion is the compliance with the wearer's eye socket contour without creating any pressure stress.

8. A swimming goggles, comprising:

a hard combining frame, composed of a first embedding frame, a second embedding frame, and a connection element interconnecting the first embedding frame and the second embedding frame, each of the first embedding frame and the second embedding frame having an embedding hole;

a left soft frame and a right soft frame, respectively assembled with the embedding holes of the first embedding frame and the second embedding frame, each of the left soft frame and the right soft frame being composed of a frame portion and a face contact portion, the frame portion having an inner wall, the inner wall of the frame portion being punched inward to form a receiving groove to receive a lens, the face contact portion being disposed with a flange rib with respect to an edge of the lens; and two hard head strap buckles, respectively connected to the first embedding frame and the second embedding frame, each of the two hard head strap buckles forming a guidance hole to provide a head strap to pass therethrough;

wherein each of the first embedding frame and the second embedding frame has an extension section, the extension section comprising a first stretching part, the first stretching part being formed with a cut angle at an edge of the extension section, so as to provide the extension section with stretching flexibility in wearing;

wherein each of the left soft frame and the right soft frame is assembled with each of the embedding holes of the first embedding frame and the second embedding frame by means of multi-stage clamping fixation, each of the first embedding frame and the second embedding frame being mounted with the at least an arc lane at a side adjacent to the connection element, and with the at least a pair of arms arranged side by side with the arc lane, the frame portion further having an inner wall, the inner wall being protruded outward to form a plurality of blocks at intervals, the frame portion of each of the left soft frame and the right soft frame is then fixed around the embedding hole of each of the first embedding frame and the second embedding frame by means of the at least an arc lane and the at least a pair of arms corporately clamping the plurality of blocks.

9. The swimming goggles of claim 8, wherein the flange rib of the face contact portion disposed with respect to the edge of the lens has a shape of a circle.

10. The swimming goggles of claim 8, wherein an upper half part of the face contact portion, with respect to a wearer's eyebrow, has a first height, and a lower half part of the face contact portion, with respect to the wearer's cheek bone, has a second height, wherein the first height is smaller than the second height, so that after the swimming goggles are worn, the face contact portion is the compliance with the wearer's eye socket contour without creating any pressure stress.

* * * * *